US009167895B2

(12) United States Patent
Couch

(10) Patent No.: US 9,167,895 B2
(45) Date of Patent: Oct. 27, 2015

(54) RETRACTABLE UTILITY RACK

(71) Applicant: George Couch, Malad, ID (US)

(72) Inventor: George Couch, Malad, ID (US)

( * ) Notice: Subject to any disclaimer, the term of this patent is extended or adjusted under 35 U.S.C. 154(b) by 133 days.

(21) Appl. No.: 13/895,150

(22) Filed: May 15, 2013

(65) Prior Publication Data

US 2014/0339184 A1 Nov. 20, 2014

(51) Int. Cl.

| | |
|---|---|
| ***A47F 7/00*** | (2006.01) |
| ***A47B 46/00*** | (2006.01) |
| ***B68B 9/00*** | (2006.01) |
| ***B68C 1/00*** | (2006.01) |
| *A47B 5/06* | (2006.01) |
| *A47B 81/00* | (2006.01) |

(52) U.S. Cl.

CPC ..... *A47B 46/005* (2013.01); *B68B 9/00* (2013.01); *B68C 1/002* (2013.01); *A47B 5/06* (2013.01); *A47B 81/00* (2013.01); *Y10T 29/49826* (2015.01)

(58) Field of Classification Search

CPC ..... A47B 5/006; A47B 5/02; A47B 5/04; A47B 5/06; A47B 46/005; A47B 81/00; B68C 1/00; B68C 1/002; B68B 9/00; Y10T 29/49826

USPC ..... 211/85.11

See application file for complete search history.

(56) References Cited

U.S. PATENT DOCUMENTS

| | | | | |
|---|---|---|---|---|
| 2,740,532 | A | 4/1952 | Kleinsmith | |
| 2,647,642 | A * | 8/1953 | Kosash | 211/100 |
| 2,952,366 | A | 9/1960 | Botten | |
| 3,133,510 | A * | 5/1964 | Maraventano | 108/33 |
| 3,147,606 | A | 9/1964 | Holmberg | |
| 3,211,295 | A | 10/1965 | Weiss | |
| 3,233,745 | A | 2/1966 | Hershberger | |
| 3,242,882 | A * | 3/1966 | Hoyt | 108/48 |
| 3,688,912 | A | 9/1972 | Wilmoth | |
| 3,780,971 | A | 12/1973 | De Filipps | |
| 3,965,588 | A * | 6/1976 | Long | 38/103 |
| 4,068,551 | A * | 1/1978 | Kreitz | 83/471.3 |
| 4,356,922 | A | 11/1982 | Dierksheide | |
| 4,393,969 | A * | 7/1983 | Woell | 193/35 TE |
| D282,705 | S | 2/1986 | Chap | |
| 4,995,322 | A * | 2/1991 | Frederick | 108/44 |
| 5,170,719 | A | 12/1992 | Pestone | |
| D338,125 | S | 8/1993 | Sample | |
| 5,590,795 | A | 1/1997 | Wright | |
| 5,615,783 | A | 4/1997 | Warnken | |
| 6,161,486 | A * | 12/2000 | Boots | 108/48 |
| 6,189,706 | B1 | 2/2001 | Akins | |
| 6,196,398 | B1 | 3/2001 | Lowe | |
| 6,726,036 | B2 | 4/2004 | Koellner | |
| 7,874,436 | B2 | 1/2011 | Hought | |
| 7,942,277 | B1 | 5/2011 | Flynn | |
| 8,327,893 | B2 * | 12/2012 | Jesberger | 144/286.1 |
| 8,677,910 | B2 * | 3/2014 | Yu et al. | 108/48 |
| 2009/0026342 | A1 * | 1/2009 | Bochner et al. | 248/460 |

* cited by examiner

*Primary Examiner* — Korie H Chan

(74) *Attorney, Agent, or Firm* — Thorpe North & Western

(57) ABSTRACT

A utility storage rack comprises a wall mount, mountable to a generally vertical wall, and a storage bed, removably and pivotally coupleable to the wall mount. The storage bed includes at least two components that are adjustable relative to one another to adjust a length of the storage bed. At least one leg is pivotally coupled to the storage bed, the at least one leg being adjustable in length to allow a height or a grade of the storage bed to be adjusted. At least one locking key is removably coupleable with the storage bed, the at least one locking key being coupleable to the storage bed to lock the at least one leg in a downwardly extending orientation, and coupleable to the storage bed to lock the at least one leg in a rotated position, nestable against the storage bed.

17 Claims, 12 Drawing Sheets

FIG. 10A
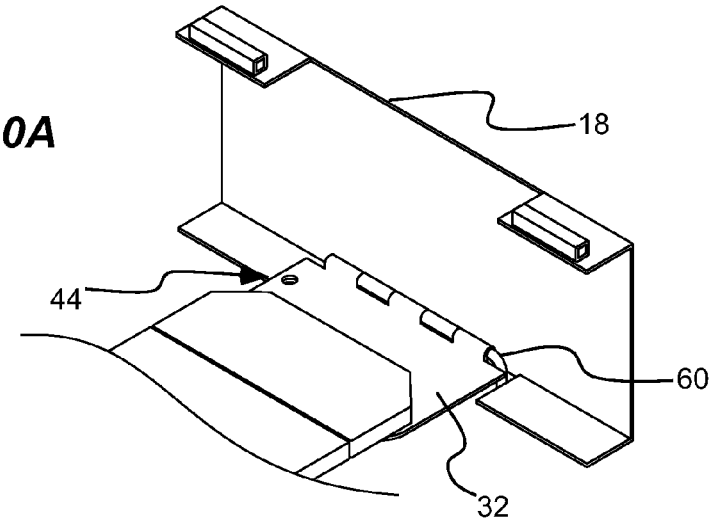
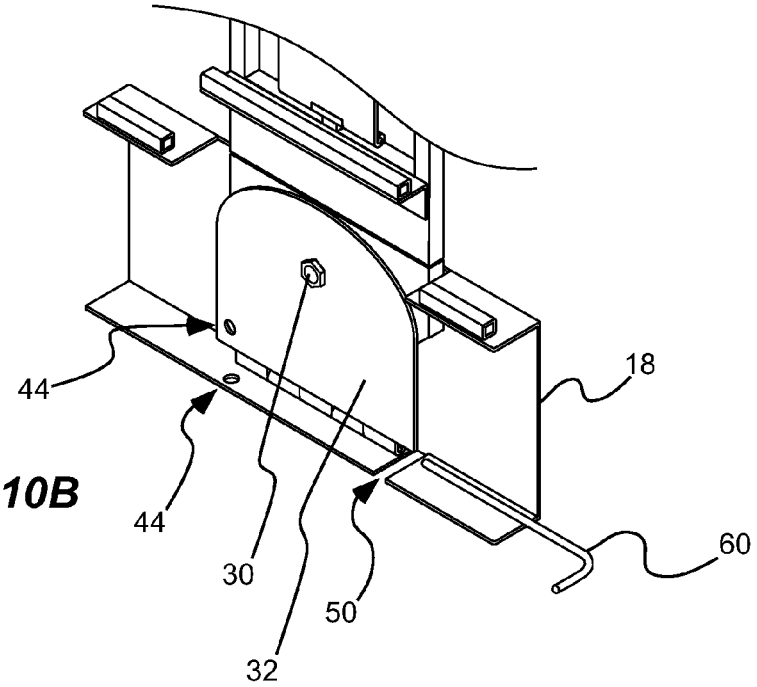
FIG. 10B

RETRACTABLE UTILITY RACK

BACKGROUND OF THE INVENTION

1. Field of the Invention

The present invention relates generally to the field of utility racks for the storage of various items. More particularly, the present invention relates to collapsible or retractable storage racks that can be retracted to consume a smaller footprint when not in use.

2. Related Art

Numerous utility systems have been developed that allow for the storage of various items in locations where those items are commonly used. For example, saddle racks in a variety of configurations have been developed for the storage of saddles and tack around stalls, horse trailers and the like.

While conventional systems abound, most such systems are relatively permanent in nature: once a saddle or the like is removed from the system, the system becomes an obstacle that must be worked around. Some such systems have been modified to provide a degree of portability. However, such systems have proven unstable and often remain a problem when in an unused state.

SUMMARY OF THE INVENTION

In accordance with one aspect of the invention, a utility storage rack is provided, including a wall mount, mountable to a generally vertical wall, and a storage bed, removably and pivotally coupleable to the wall mount. The storage bed can include at least two components that are adjustable relative to one another to adjust a length of the storage bed. At least one leg can be pivotally coupled to the storage bed, the at least one leg being adjustable in length to allow a height or a grade of the storage bed to be adjusted. At least one locking key can be removably coupleable with the storage bed, the at least one locking key being coupleable to the storage bed to lock the at least one leg in a downwardly extending orientation, and coupleable to the storage bed to lock the at least one leg in a rotated position, nestable against the storage bed.

In accordance with another aspect of the invention, a method for providing storage of one or more saddles on a storage rack is provided, including: mounting a wall mount to a substantially vertical wall; removably and pivotably coupling a storage bed to the wall mount, the storage bed including at least one leg rotatably coupled thereto; rotating the storage bed relative to the wall mount about a substantially horizontal axis to position the storage bed in a substantially horizontal orientation; extending the at least one leg to contact a ground surface adjacent the substantially vertical wall; and fixing a position of the at least one leg relative to the storage bed to enable the leg to support the storage bed in the substantially horizontal orientation.

In accordance with another aspect of the invention, a saddle rack system is provided, including a plurality of wall mounts, each mountable to a generally vertical structure, and a storage bed, removably and pivotally coupleable to any of the wall mounts. The storage bed can include at least two components that are adjustable relative to one another to adjust a length of the storage bed. At least one leg can be pivotally coupled to the storage bed, the at least one leg being adjustable in length to allow a height or a grade of the storage bed to be adjusted. At least one locking key can be removably coupleable with the storage bed, the at least one locking key being coupleable to the storage bed to lock the at least one leg in a downwardly extending orientation, and coupleable to the storage bed to lock the at least one leg in a rotated position, nestable against the storage bed.

Additional features and advantages of the invention will be apparent from the detailed description which follows, taken in conjunction with the accompanying drawings, which together illustrate, by way of example, features of the invention.

BRIEF DESCRIPTION OF THE DRAWINGS

The following drawings illustrate exemplary embodiments for carrying out the invention. Like reference numerals refer to like parts in different views or embodiments of the present invention in the drawings.

FIG. 10A is a more detailed view of a pivot pin in accordance with an embodiment of the invention;

FIG. 10B is a more detailed view of the pivot pin of FIG. 10A, shown in a removed configuration;

DETAILED DESCRIPTION

Figure 1:
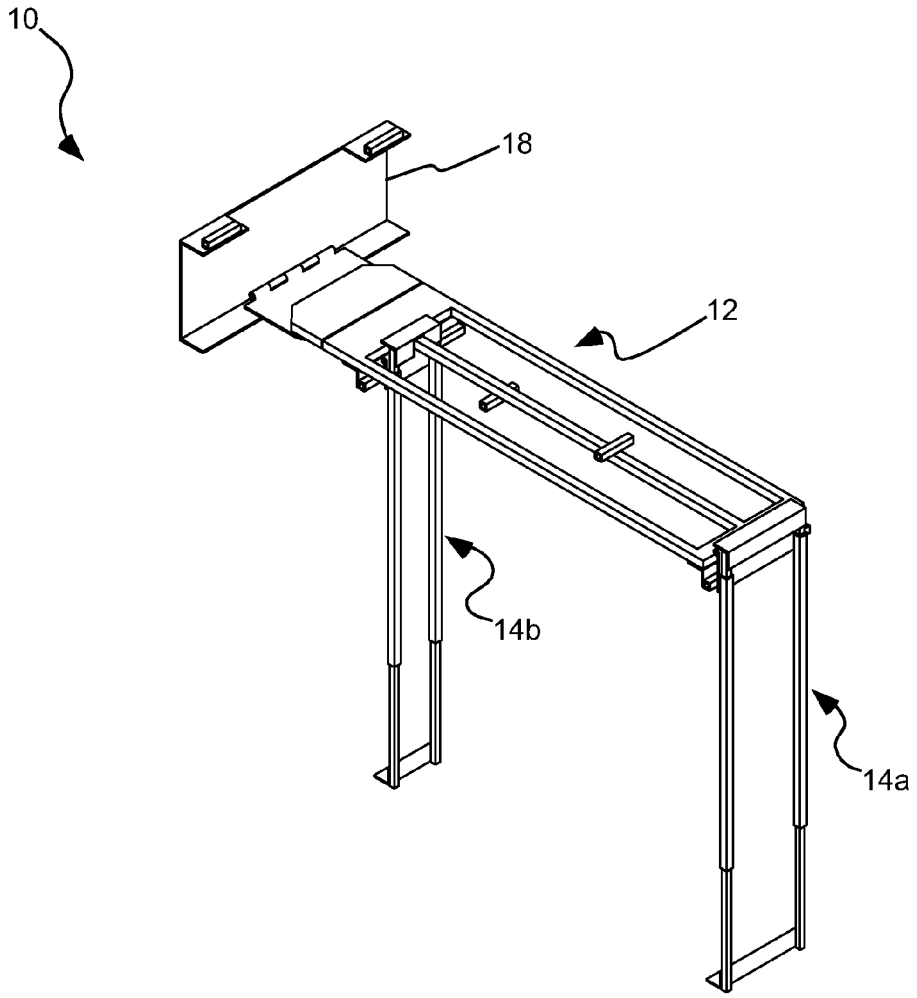
FIG. 1 is a perspective view of a retractable utility rack shown in an extended, ready to use configuration.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

DEFINITIONS

As used herein, the singular forms "a" and "the" can include plural referents unless the context clearly dictates otherwise. Thus, for example, reference to "a voice coil actuator" can include one or more of such actuators.

As used herein, the terms "attached," "coupled," fixed," etc., can be used to describe a condition in which two or more components are coupled to one another in such a manner that they function as intended: that is, the force required to uncouple the components is sufficiently large such that the components will remain attached to one another during the service for which they were designed. In some embodiments of the invention, various components can be "permanently" coupled to one another: in such a case, the components are coupled to one another such that some deformation of one or both of the components, or the fasteners used to couple the components, will occur if the components are uncoupled from one another. One example of such a coupling can occur when two or more components are welded, bonded or otherwise adhered to one another.

In other aspects, various components can be "removably" coupled to one another such that they can be separated without causing permanent deformation of the components, or the fasteners used to couple the components. One example of such a coupling can occur when two or more components are bolted to one another (in which case, removal of nuts coupled to bolts can result in uncoupling of the components without damaging the nuts or the bolts), or when a pin is used to secure one or more components in position relative to each other, or when two or more components are slidably insertable one within another to provide a telescoping relationship.

Directional terms, such as "vertical," "horizontal," "upper," "lower," etc., are used herein to describe relative positions of various components. It is to be understood that such usage is an effort to most clearly describe, and, where applicable, claim, the features of the invention and is not be to limiting unless the context clearly indicates otherwise. Such directional terms are used in a manner that will be readily understood by one of ordinary skill in the art having possession of this disclosure.

As used herein, the term "substantially" refers to the complete or nearly complete extent or degree of an action, characteristic, property, state, structure, item, or result. As an arbitrary example, an object that is "substantially" enclosed would mean that the object is either completely enclosed or nearly completely enclosed. The exact allowable degree of deviation from absolute completeness may in some cases depend on the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result. As another arbitrary example, a composition that is "substantially free" of an ingredient or element may still actually contain such item as long as there is no measurable effect thereof.

As used herein, the term "about" is used to provide flexibility to a numerical range endpoint by providing that a given value may be "a little above" or "a little below" the endpoint.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 1 to about 5" should be interpreted to include not only the explicitly recited values of about 1 to about 5, but also include individual values and sub-ranges within the indicated range. Thus, included in this numerical range are individual values such as 2, 3, and 4 and sub-ranges such as from 1-3, from 2-4, and from 3-5, etc., as well as 1, 2, 3, 4, and 5, individually.

This same principle applies to ranges reciting only one numerical value as a minimum or a maximum. Furthermore, such an interpretation should apply regardless of the breadth of the range or the characteristics being described.

INVENTION

The present invention relates generally to utility racks that can be used to store a variety of items. While not so limited, the rack has been found to be particularly effective to store saddles and tack associated with horse riding. The rack can be retracted into a storage configuration that is compact and exhibits a very low footprint. In one aspect, the rack can be mounted to a wall or other vertical structure and can be folded upwardly into a storage configuration, and extended downwardly into a useable configuration.

Figure 2A:
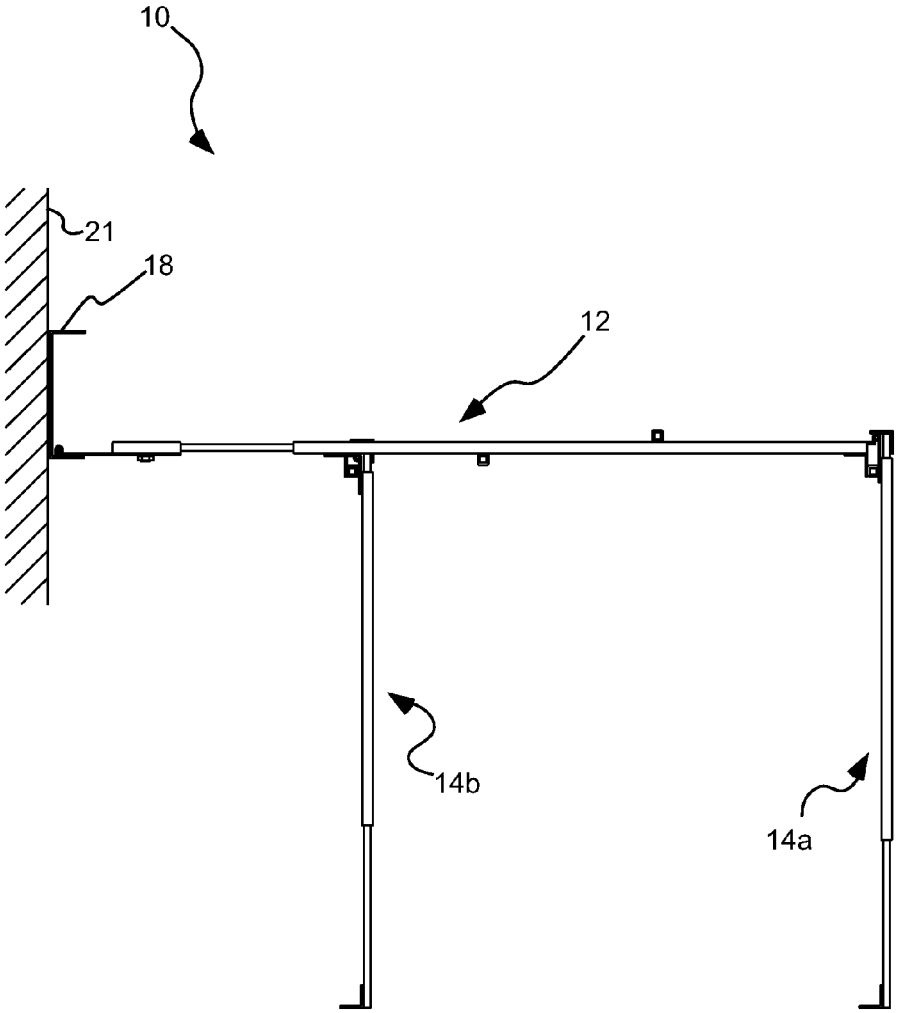
FIG. 2A is side view of the retractable utility rack of FIG. 1.

Turning now to the figures, a system 10 in accordance with the present technology is shown for storing utility items of a variety of natures. While the system can be used in a variety of applications, in one embodiment it has been found to work well for storing saddles, tack and related items. The system generally includes a wall mount 18 that can be mounted to a variety of surfaces. Typically, the wall mount is attached to a generally vertical wall (21 in FIG. 2A), such as that found in most dwellings, or walls of horse trailers, utility trailers, etc. A storage bed 12 can be generally removably coupled to the wall mount. In the examples shown, a pin 60 (best seen in FIGS. 10A and 10B) is used couple the storage bed to the wall mount. Thus, in most applications, the wall mount is attached to a structure near which the rack will be used.

Once attached, the storage bed 12 can be easily removed or attached to the wall mount 18, providing a portable storage system that can be relatively easily moved from one location to another. If desired, a number of wall mounts 18 can be acquired by a consumer; each attached in various locations where the storage rack might be used. For example, an owner can purchase multiple wall mounts and install one within his garage, one near his horse stalls, one inside (and outside) a horse or utility trailer, etc. The storage rack can then be moved from one location to another, and very easily installed by simply aligning the various components and installing pin 60 (as discussed in more detail below) in place.

Figure 3:
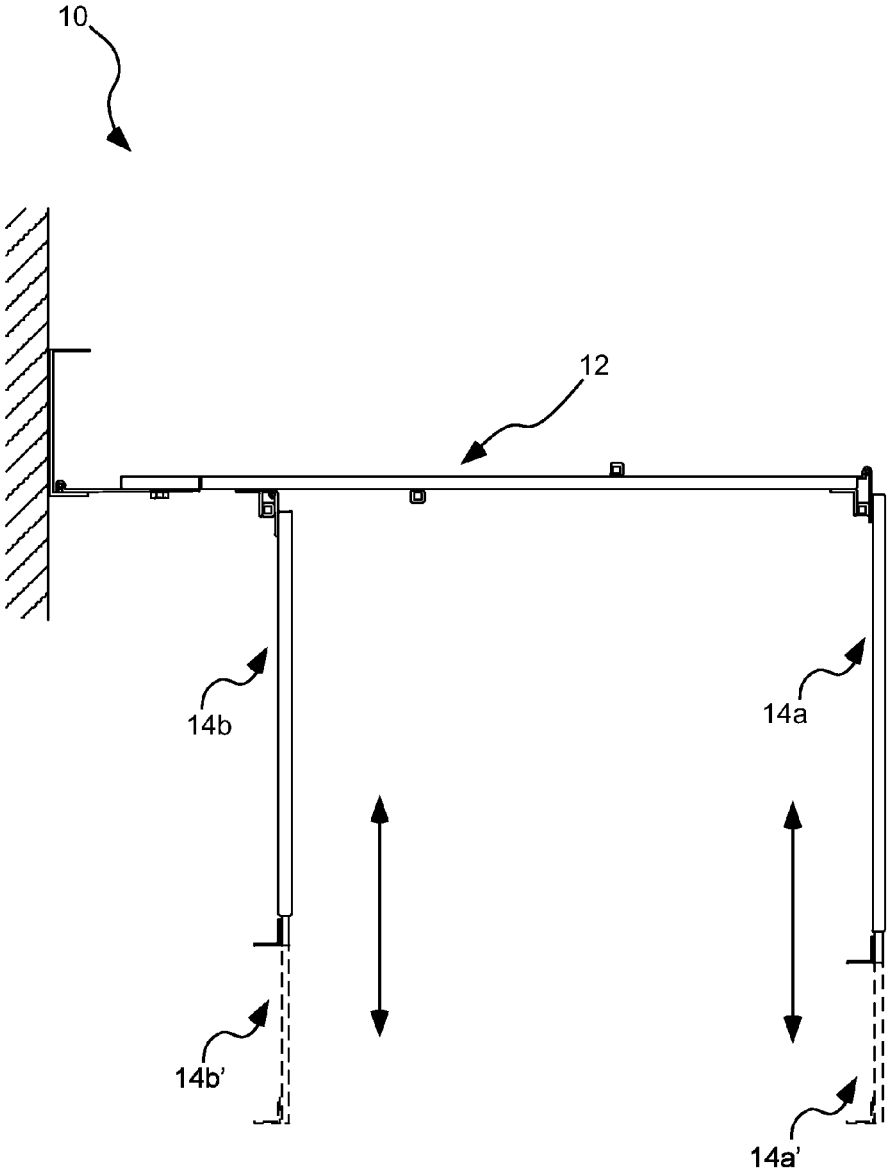
FIG. 3 is a side view of the retractable utility rack of FIG. 1, shown with the adjustable legs in two different positions.

The system can include legs 14*a*, 14*b* that can allow a variety of adjustments to the system. As shown in FIG. 3, the legs can include telescoping members 14*a*, 14*a*', 14*b*, 14*b*', etc., that can allow a height of the legs to be adjusted. Once a desired height is selected, set screws or similar fasteners can be used to secure the leg components and prevent them from moving relative to one another. For example, lag bolts can be threaded through the outer member 14*a*, and tightened against the inner member 14*a*' to prevent the two from moving relative to one another.

Figure 8:
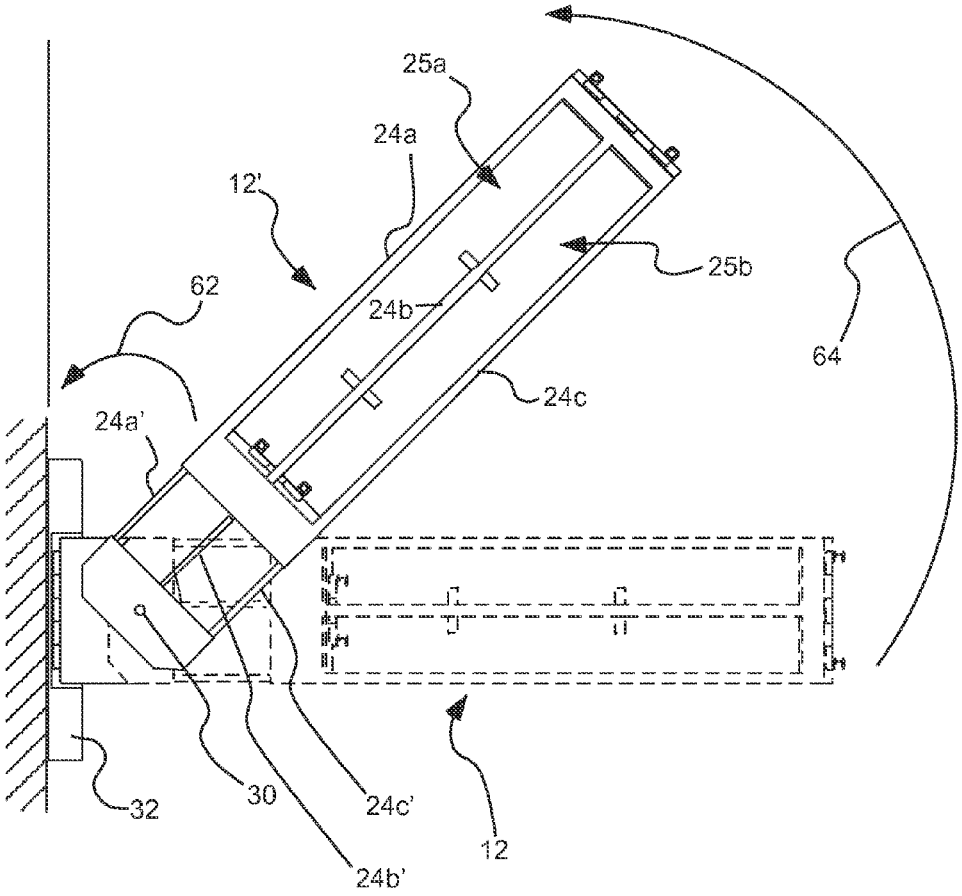
FIG. 8 is a top view of the retractable utility rack of FIG. 1, shown in a first position and a second, pivoted position.
Figure 9:
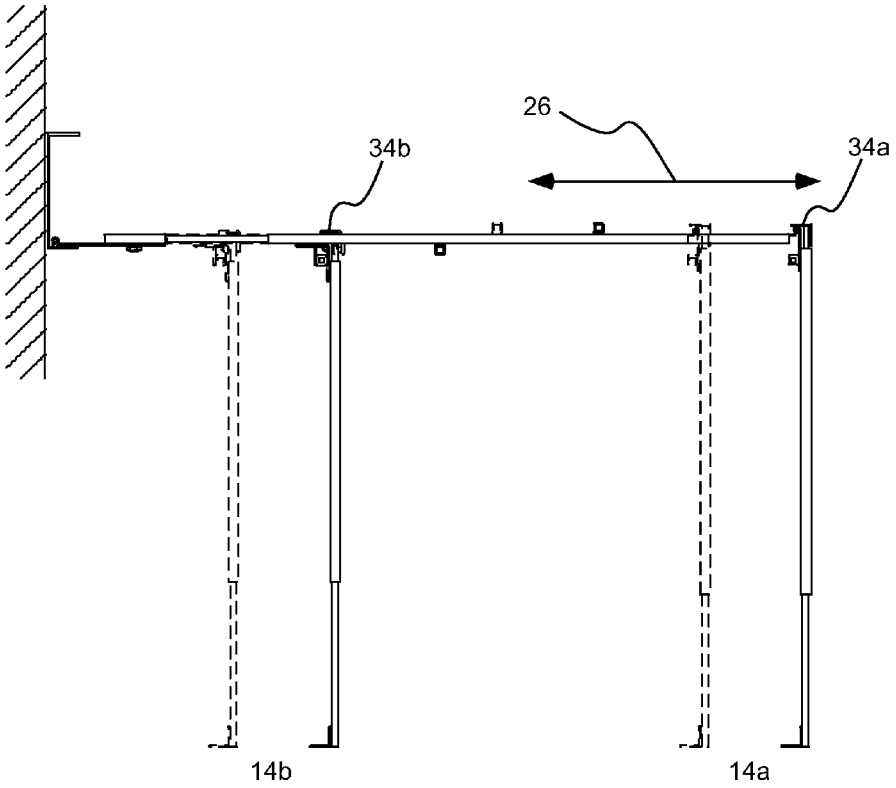
FIG. 9 is a side view of the retractable utility rack of FIG. 1, shown with the bed in a first position and a second, extended position.
Figures 11A, 11B:
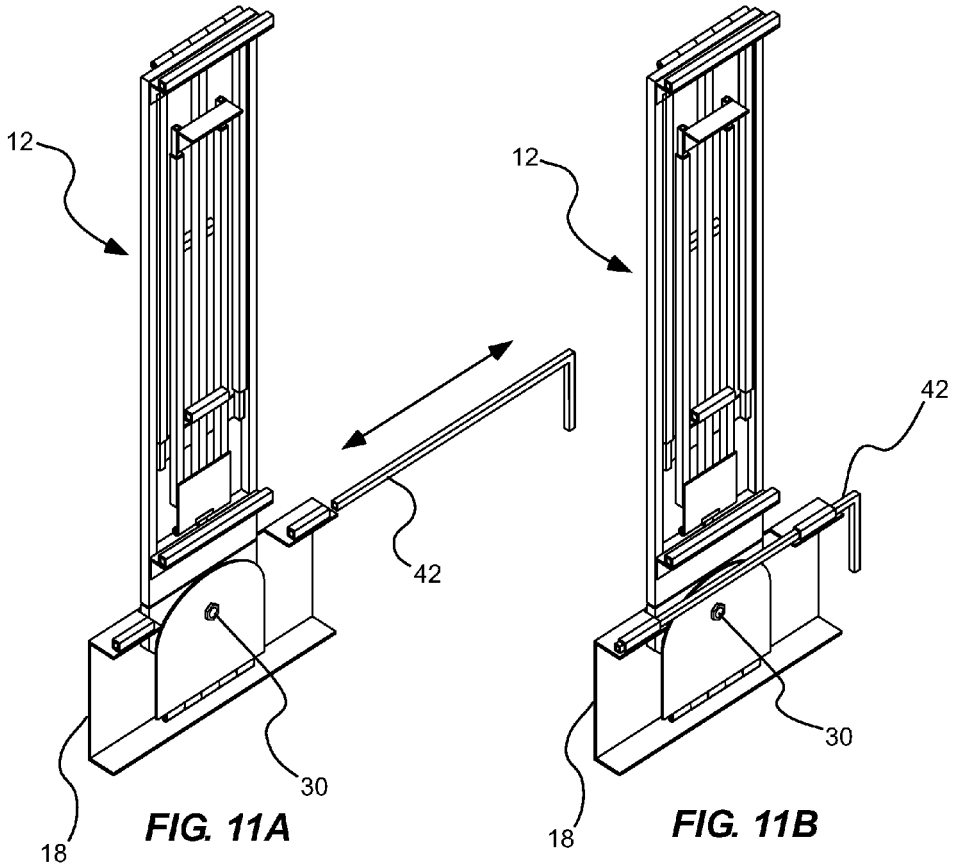
FIG. 11A is perspective view of the retractable utility rack shown with a locking pin in a removed condition.
FIG. 11B is a perspective view of the retractable utility rack of FIG. 11A, shown with the locking pin in a locked position.

A similar arrangement can be provided with the components that comprise the bed 12 of the rack. As shown for example in FIG. 8, the bed can be formed from three substantially parallel elements 24*a*, 24*b*, 24*c*. Each of these components can include an inner and outer telescoping member that allows the length of the bed to be adjusted. See, for example, FIG. 9, which illustrates adjustment of these components to adjust an overall length of the bed 12, as illustrated by directional indicator 26. FIG. 8 illustrates inner members 24*a*', 24*b*', 24*c*', which slide inside outer elements 24*a*, 24*b*, 24*c*, respectively, to provide a telescoping arrangement. Note that lengthwise adjustment of the bed of the rack will also typically adjust a lateral distance of the legs 14*a*, 14*b* from the wall 21.

Thus, it can be seen that a vertical height of the bed 12, as well as a vertical slope of the bed, can be easily adjusted by adjusting the telescoping components of the legs 14*a*, 14*b*. It may be desirable to adjust the slope of the bed in locations where the floor or surrounding terrain is not level: in this case, one of the legs can be easily adjusted to be longer or shorter than the other, thereby compensating for such unevenness.

Thus, once the bed 12 is coupled to the wall mount 18, the proper height and slope of the bed can easily be adjusted. In addition, as shown in FIG. 8, an angle at which the bed sits relative to the wall 21 can also be adjusted. Pin 30 (FIGS. 8, 10B, 11 and 11A) can be provided that allows the majority of the bed 12 to swivel about pin 30 relative to mounting flange 32 (as shown by directional indicators 62, 64). In this manner, the bed can be maintained in a position, relative to wall 21, best suited for the tasks being addressed about the rack. When the rack is not in use, it can be swiveled about pin 30 very close to wall 21 to make room for other items.

Figure 4:
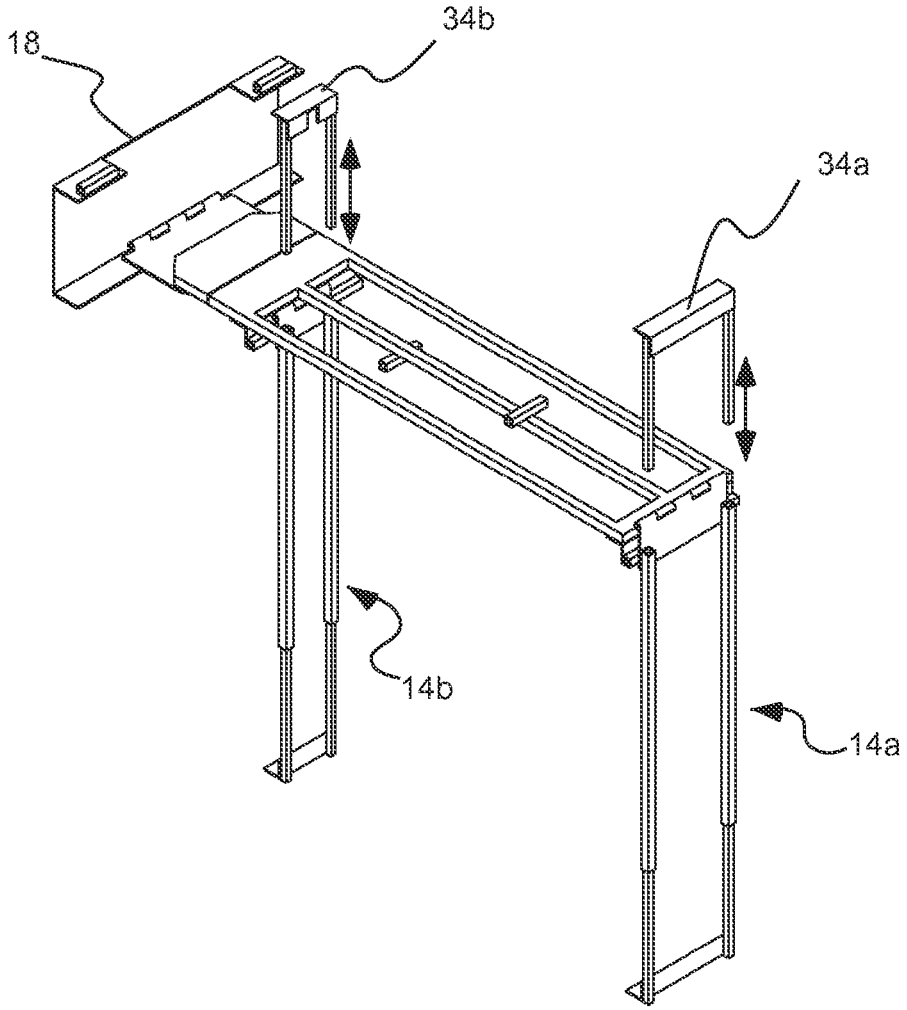
FIG. 4 is a perspective view of the retractable utility rack of FIG. 1, shown with the leg pivoting keys shown in a removed condition.
Figure 5:
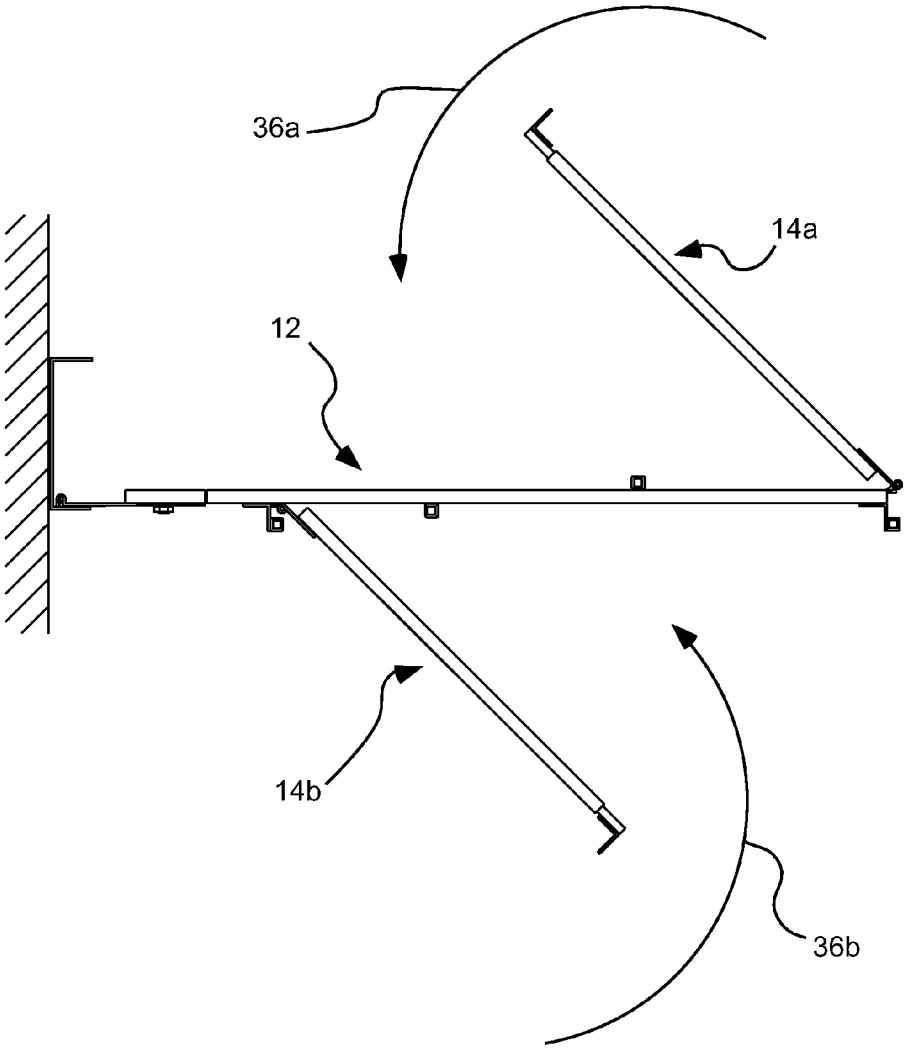
FIG. 5 is a side view of the retractable utility rack of FIG. 1, shown with the leg sections partially rotated into a storage configuration.

In addition to being adjustable in height, length, and angular position relative to the wall 21, the rack 10 is provided with a number of features that allow it to easily be stored in an upright position when not in use. Beginning with FIG. 4, locking keys 34*a*, 34*b* can be used initially to secure legs 14*a*, 14*b* in the downward, extended position (as shown in FIG. 4). When it is desired to fold the unit, the keys 34*a*, 34*b* can be removed from the secured position, such as that shown in FIG. 9. Legs 14*a*, 14*b* can then be rotated, as shown by directional indicators 36*a*, 36*b* in FIG. 5. Leg 14*b* can be swiveled until it rests against (or at least partially nests within) bed 12. Leg 14*a* can swivel greater than 180 degrees: from beneath the bed, around the end, and resting upon or at least partially nesting within the upper portion of the bed (e.g., on an opposite side of the bed as leg 14*b* is positioned).

Figure 6:
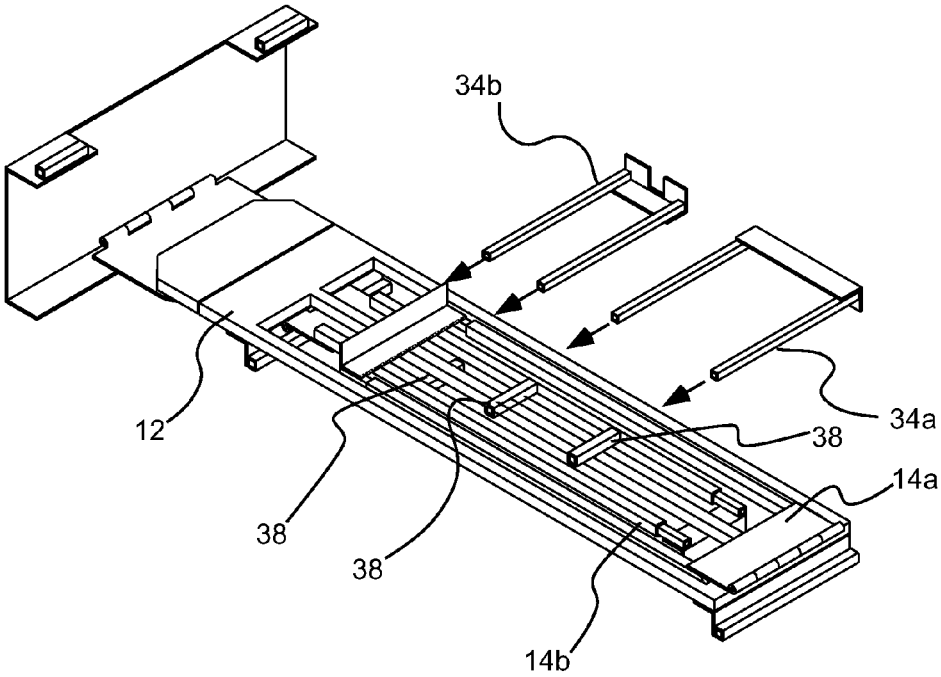
FIG. 6 is a perspective view of the retractable utility rack of FIG. 1, shown with the leg sections in a storage configuration, and shown with the leg pivoting keys in a locking position, different from that of FIG. 4.
Figure 7:
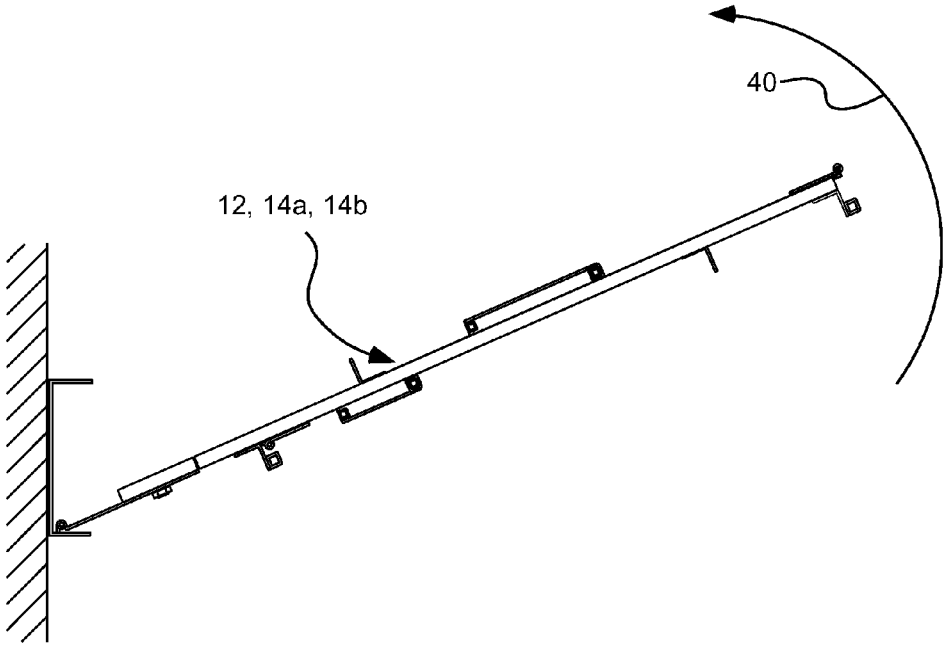
FIG. 7 is a side view of the retractable utility rack of FIG. 1, shown in a partially raised position.

FIG. 6 illustrates the bed 12 with the each of the legs 14*a*, 14*b* swiveled into a storage position. Keys 34*a*, 34*b* than then be inserted into receiving structure 38, and pin the legs 14*a*, 14*b* into position relative to the bed 12. At this point, the bed (and legs pinned thereto) can be relatively easily moved about, without the legs swiveling and interfering with movement of the bed. As shown by directional indicator 40 in FIG. 7, the bed (and legs) can be swiveled upwardly until it is in the position shown in FIGS. 11 and 11A. At this point, key 42 can be installed, thereby pinning the bed above the wall mount 18. In one aspect of the invention, the entire rack can be secured against the wall without protruding from the wall more than about 6 inches. As the entire rack is stored above the wall mount 18, the storage area beneath the wall mount is not interfered with when the rack is not in use.

Figure 2B:
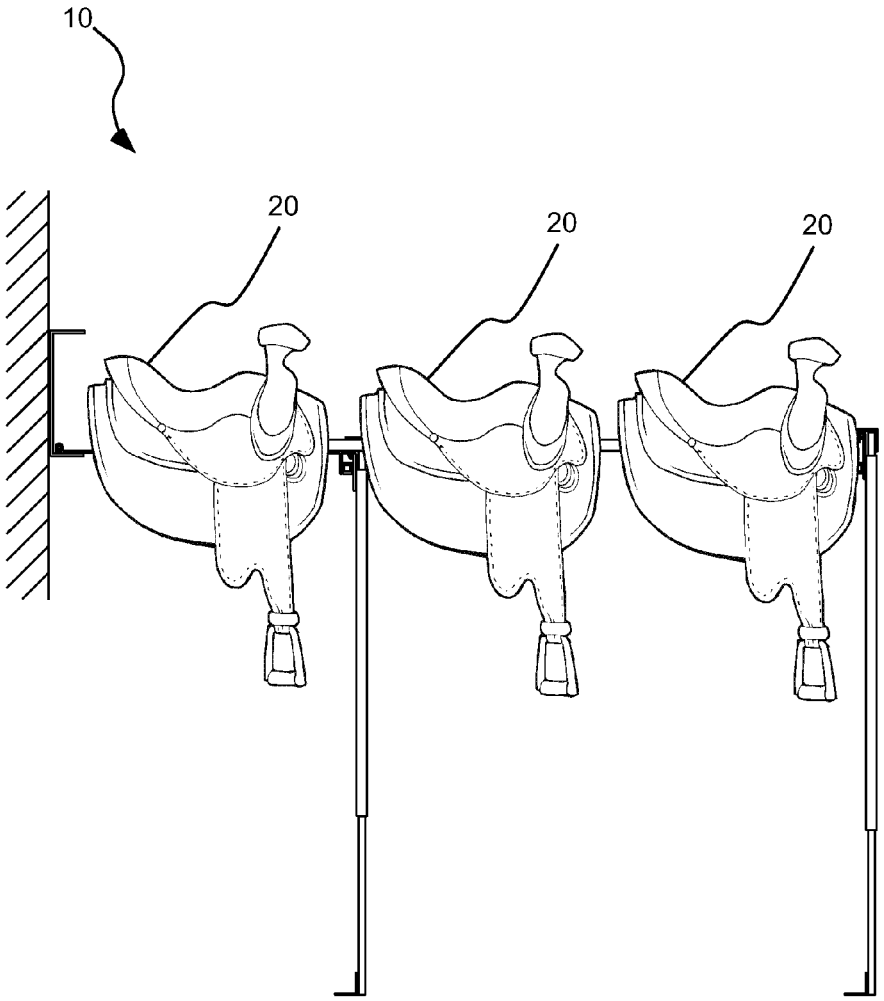
FIG. 2B is side view of the retractable utility rack of FIG. 1, shown with three saddles stored thereon.

As is shown by example in FIG. 2B, the rack system can be used so store up to three saddles 20 along a length of the bed 12. As shown in FIG. 8, slats 24*a*, 25*b* and 24*c* each define therebetween a series of openings 25*a*, 25*b*. The slats can thus be used to hang sheet goods, such as saddle blankets and like beneath the saddles. Other tack can also be suspended from the slats and stored beneath the saddles.

FIGS. 10A and 10B illustrate another feature of the invention. In this embodiment, the wall mount 18 and the mounting flange 32 each include a padlock receiving opening 44 formed therein. Receiving structure can be formed in the wall mount and the mounting flange to receive pin 60 therein. The receiving structure can be positioned with a slot 50 adjacent thereto, such that pin 60 can only be inserted or withdrawn when the bed 12 is in the upright position (as shown in FIG. 10B). In this orientation, the pin can be inserted, and rotated down into the slot 50. Once the bed 12 is rotated downward, however, the pin cannot be withdrawn from the receiving structure. A padlock (not shown) placed through the openings 44 will prevent the bed from being raised; thereby preventing the bed from being removed from the wall mount. In this manner, an owner can ensure that the bed is not removed due to theft, or by accident.

In addition to the structure outlined above, the present invention also provides a method for providing storage of one or more saddles on a storage rack, comprising: mounting a wall mount to a substantially vertical wall; removably and pivotably coupling a storage bed to the wall mount, the storage bed including at least one leg rotatably coupled thereto; rotating the storage bed relative to the wall mount about a substantially horizontal axis to position the storage bed in a substantially horizontal orientation; extending the at least one leg to contact a ground surface adjacent the substantially vertical wall; and fixing a position of the at least one leg relative to the storage bed to enable the leg to support the storage bed in the substantially horizontal orientation.

The method can also include fixing a position of at least two legs relative to the storage bed, wherein the two legs are rotatable relative to the storage bed in opposing directions of rotation. The method can further comprise rotating the storage bed about a substantially vertical axis to adjust an angle between the storage bed and the substantially vertical wall. The method can also include manipulating the storage rack into a storage position by: folding the at least one leg into substantially parallel contact with the storage bed; locking the at least one leg in the locked position; rotating the storage bed upwardly into contact with the substantially vertical wall such the storage bed is positioned above the wall mount; and securing the storage bed relative to the wall mount to prevent the storage bed from rotating away from the substantially vertical wall.

The method can also include removably and pivotably coupling the storage bed to the wall mount comprising installing a pin through receiving structure in each of the storage bed and the wall mount. The pin can be positioned such that the pin cannot be removed from the storage bed and the wall mount when the storage bed is in the horizontal position. The storage bed and the wall mount can be padlocked one to another while the storage bed is in the horizontal position.

It is to be understood that the above-referenced arrangements are illustrative of the application for the principles of the present invention. Numerous modifications and alternative arrangements can be devised without departing from the spirit and scope of the present invention while the present invention has been shown in the drawings and described above in connection with the exemplary embodiments(s) of the invention. It will be apparent to those of ordinary skill in the art that numerous modifications can be made without departing from the principles and concepts of the invention as set forth in the examples.

I claim:

1. A utility storage rack, comprising:

a wall mount, mountable to a generally vertical wall;

a storage bed, removably and pivotally coupleable to the wall mount, the storage bed including at least two components that are adjustable relative to one another to adjust a length of the storage bed;

at least one leg, pivotally coupled to the storage bed, the at least one leg being adjustable in length to allow a height or a grade of the storage bed to be adjusted; and at least one locking key, removably coupleable with the storage bed, the at least one locking key being coupleable to the storage bed to lock the at least one leg in a downwardly extending orientation, and coupleable to the storage bed to lock the at least one leg in a rotated position, nestable against the storage bed.

2. The storage rack of claim 1, wherein the storage bed is coupled to a pivot, the pivot allowing the storage bed to rotate relative to the wall mount about a horizontal axis.

3. The storage rack of claim 1, wherein the storage bed is coupled to a pivot, the pivot allowing the storage bed to rotate relative to the wall mount about a vertical axis.

4. The storage rack of claim 1, wherein the storage bed includes a series of slats and a series of open spaces defined between the slats, the slats providing a rack for hanging of sheet goods from the storage bed.

5. The storage rack of claim 4, wherein at least some of the slats are hollow and include extendable members that are slidable within the slats to allow the storage bed to be adjustable in length.

6. The storage rack of claim 1, wherein the storage bed is sized and shaped to provide storage for saddles thereon.

7. The storage rack of claim 1, wherein the storage bed is rotatable into a wall mount storage configuration to rest substantially flush against a wall structure to which the wall mount is coupled.

8. The storage rack of claim 7, wherein the storage rack is lockable in the wall mount storage configuration and extends no more than about six inches from the wall structure when in the wall mount storage configuration.

9. The storage rack of claim 8, wherein the storage rack is held in the wall mount storage configuration such that no structure of the storage rack extends below the wall mount.

10. The storage rack of claim 1, wherein a portion of the wall mount and a portion of the storage bed include a padlock access hole: and, wherein the wall mount and the storage bed are padlockable one to another when the storage bed is in an extended, storage configuration.

11. The storage rack of claim 1, further comprising two or more legs pivotally coupled to the storage bed, the two or more legs being rotatable relative to the storage bed and nestable against the storage bed on opposite sides of the storage bed.

12. A method for providing storage of one or more saddles on a storage rack, comprising:

mounting a wall mount to a substantially vertical wall;

removably and pivotably coupling a storage bed to the wall mount, the storage bed including at least one leg rotatably coupled thereto;

rotating the storage bed relative to the wall mount about a substantially horizontal axis to position the storage bed in a substantially horizontal orientation;

extending the at least one leg to contact a ground surface adjacent the substantially vertical wall;

fixing a position of the at least one leg relative to the storage bed to enable the leg to support the storage bed in the substantially horizontal orientation;

wherein removably and pivotably coupling the storage bed to the wall mount comprises installing a pin through receiving structure in each of the storage bed and the wall mount and positioning the pin such that the pin cannot be removed from the storage bed and the wall mount when the storage bed is in the horizontal position; and padlocking the storage bed and the wall mount one to another while the storage bed is in the horizontal position.

13. The method of claim 12, further comprising fixing a position of two or more legs relative to the storage bed, wherein the two or more are rotatable relative to the storage bed in opposing directions of rotation.

14. The method of claim 12, further comprising rotating the storage bed about a substantially vertical axis to adjust an angle between the storage bed and the substantially vertical wall.

15. The method of claim 12, further comprising manipulating the storage rack into a storage position by:

folding the at least one leg into substantially parallel contact with the storage bed;

locking the at least one leg in the locked position;

rotating the storage bed upwardly into contact with the substantially vertical wall such the storage bed is positioned above the wall mount; and securing the storage bed relative to the wall mount to prevent the storage bed from rotating away from the substantially vertical wall.

16. A saddle rack system, comprising:

a plurality of wall mounts, each mountable to a generally vertical structure;

a storage bed, removably and pivotally coupleable to any of the wall mounts, the storage bed including at least two components that are adjustable relative to one another to adjust a length of the storage bed;

at least one leg, pivotally coupled to the storage bed, the at least one leg being adjustable in length to allow a height or a grade of the storage bed to be adjusted; and at least one locking key, removably coupleable with the storage bed, the at least one locking key being coupleable to the storage bed to lock the at least one leg in a downwardly extending orientation, and coupleable to the storage bed to lock the at least one leg in a rotated position, nestable against the storage bed.

17. The system of claim 16, further comprising two or more legs pivotally coupled to the storage bed, the two or more legs being rotatable relative to the storage bed and nestable against the storage bed on opposite sides of the storage bed.

* * * * *